US008662915B2

(12) United States Patent
Ueda et al.

(10) Patent No.: US 8,662,915 B2
(45) Date of Patent: Mar. 4, 2014

(54) CONNECTOR

(75) Inventors: Kouhei Ueda, Tokyo (JP); Masao Higuchi, Tokyo (JP); Yoshihiro Sugi, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 12 days.

(21) Appl. No.: 13/154,020

(22) Filed: Jun. 6, 2011

(65) Prior Publication Data

US 2012/0045930 A1 Feb. 23, 2012

(30) Foreign Application Priority Data

Aug. 19, 2010 (JP) ..... 2010-184188

(51) Int. Cl.
*H01R 13/15* (2006.01)
*H01R 13/62* (2006.01)

(52) U.S. Cl.
USPC ..... 439/493; 439/495; 439/260; 439/261

(58) Field of Classification Search
USPC ..... 439/492, 493, 495, 497, 327, 259–263
See application file for complete search history.

(56) References Cited

U.S. PATENT DOCUMENTS 5,839,916 A * 11/1998 Chishima ..... 439/495
6,231,378 B1 * 5/2001 Wu et al. ..... 439/495
6,679,713 B2 * 1/2004 Miura ..... 439/495
7,134,891 B2 * 11/2006 Kayama et al. ..... 439/495
2003/0060072 A1 3/2003 Miura

FOREIGN PATENT DOCUMENTS

CN 1409443 A 4/2003
JP 2003-100370 A 4/2003
JP 2006-134708 A 5/2006
JP 2008-091284 A 4/2008

OTHER PUBLICATIONS

Japanese Office Action and English translation for Japanese Application No. 2010-184188; issued Jun. 26, 2012; 3 pages.
Chinese Office Action with English translation; Nov. 5, 2013; 13 pages.
Taiwan Office Action in with partial English translation; Oct. 7, 2013; 13 pages.

* cited by examiner

*Primary Examiner* — Felix O Figueroa
(74) *Attorney, Agent, or Firm* — Foley & Lardner LLP

(57) ABSTRACT

A connector for connecting an FFC to a substrate includes a plurality of signal contacts, a ground contact, and a housing. The signal contacts are arranged to come into contact with signal terminals of the FFC. The ground contact comes into contact with the ground terminal of the FFC. The housing holds the plurality of signal contacts and the ground contact. A first distance from an end of the housing to a contact point of each signal contact with each signal terminal is set to be substantially equal to a second distance from an end of the housing to a contact point of the ground contact with the ground terminal. The first and second distances are measured along a direction in which one of the FFC and the FPC is inserted into or removed from the connector.

8 Claims, 21 Drawing Sheets

RELATED ART

RELATED ART

CONNECTOR

INCORPORATION BY REFERENCE

This application is based upon and claims the benefit of priority from Japanese patent application No. 2010-184188, filed on Aug. 19, 2010, the disclosure of which is incorporated herein in its entirety by reference.

BACKGROUND OF THE INVENTION

1. Field of the Invention

The present invention relates to a connector for connecting an FTC (Flexible Flat Cable) or FPC (Flexible Printed Circuits) to a substrate.

2. Description of Related Art

As a technique of this kind, Japanese Patent Application Publication No. 2006-134708 (hereinafter referred to as "Patent Document 1") discloses a connector for a flexible substrate, into/from which an FPC can be inserted/removed and which is connected to a printed wiring board. As shown in FIG. 20 of this application, the connector includes a number of signal contacts 80, an earth contact 81*a*, an earth contact 81*b*, a housing 82, and an open/close cover 84. The signal contacts 80 are arranged in the right-left direction. The earth contact 81*a* is disposed on the left side of the direction in which the signal contacts 80 are arranged. The earth contact 81*b* is disposed on the right side of the arrangement direction. The housing 82 has incorporated therein the signal contacts 80, the earth contact 81*a*, and the earth contact 81*b*. The open/close cover 84 is axially supported by the housing 82 and rotates so as to open/close an opening 83. As shown in FIGS. 20 and 21 of this application, an FPC 85 includes a flexible substrate 86, a shield member 87, a protective plate 88, and an earth connection piece 89. The flexible substrate 86 includes a plurality of signal lines. The protective plate 88 is adapted to increase the rigidity at ends of the FPC 85. When the open/close cover 84 is positioned at an unlock position to open the opening 83, the FPC 85 can be inserted into the housing 82. Meanwhile, when the FPC 85 is inserted into the housing 82 and the open/close cover 84 is positioned at a lock position to close the opening 83, the signal contacts 80 are connected to the signal lines of the FPC 85. At this time, the earth contacts 81*a* and 81*b* are in contact with the earth connection piece 89.

SUMMARY OF THE INVENTION

The present inventors have found that the connector disclosed in Patent Document 1 has a room for improvement in the depth thereof. Therefore, an object of the present invention is to provide a technique for reducing the depth of a connector.

An exemplary aspect of the present invention is a connector for connecting one of a flexible flat cable (FFC) and a flexible printed circuit (FPC) having a plurality of signal terminals and at least one ground terminal to a substrate, the connector being mounted on the substrate, the connector including: a plurality of signal contacts arranged to come into contact with the signal terminals of one of the FFC and the FPC, respectively; at least one ground contact that comes into contact with the ground terminal of one of the FFC and the FPC; and a housing that holds the plurality of signal contacts and the ground contact. Assuming that an end of the housing in a direction in which one of the FFC and the FPC is inserted into or removed from the connector is set as a reference, a first distance to a contact point of each signal contact with respect to each signal terminal is set to be substantially equal to a second distance to a contact point of the ground contact with respect to the ground terminal.

Preferably, the connector further includes a contact pressure generating portion that generates a contact pressure between the ground terminal of one of the FFC and the FPC and the ground contact, when the FFC or FPC is inserted into the connector.

Preferably, the contact pressure generating portion is provided on an opposite side to the ground contact with one of the FFC and the FPC interposed therebetween, and is composed of a pressing member that presses the ground terminal of one of the FFC and the FPC against the ground contact.

Preferably, the pressing member is a plate spring.

Preferably, the ground contact and the contact pressure generating portion are integrally formed.

Preferably, the ground contact and the contact pressure generating portion constitute a temporary holding structure that is structured to be capable of changing a position of the temporary holding structure relative to the housing.

Preferably, the plurality of signal contacts are zero insertion force (ZIF) type. The connector further includes a pressurizing member that allows the plurality of signal contacts to come into contact with the plurality of signal terminals, respectively.

Preferably, a temporary holding structure composed of the ground contact and the contact pressure generating portion is independent in operation from the pressurizing member.

Preferably, a pair of temporary holding structures each composed of the ground contact and the contact pressure generating portion are provided at positions where the plurality of signal contacts are sandwiched in a direction in which the plurality of signal contacts are arranged.

Preferably, the pair of temporary holding structures are separately formed.

Preferably, the at least one ground contact is provided in pair at positions where the plurality of signal contacts are sandwiched in a direction in which the plurality of signal contacts are arranged.

Preferably, the pair of ground contacts are separately formed.

Preferably, the connector further includes an assistant fixture that fixes the housing to the substrate. The ground contact and the assistant fixture are integrally formed.

Preferably, a signal contact portion serving as a contact portion of the signal contacts with respect to the signal terminals is disposed on an opposite side to a ground contact portion serving as a contact portion of the ground contact with respect to the ground terminal with one of the FFC and the FPC interposed therebetween.

Preferably, a signal contact portion serving as a contact portion of the signal contacts with respect to the signal terminals is disposed on the same side as a ground contact portion serving as a contact portion of the ground contact with respect to the ground terminal, when viewed from one of the FFC and the FPC.

According to an exemplary aspect of the present invention, the depth of the connector can be reduced as compared with the structure in which the first distance and the second distance are quite different from each other (e.g., a connector disclosed in Patent Document 1).

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS (First Embodiment)

Hereinafter, a first embodiment of the present invention will be described with reference to FIGS. 1 to 16.

Figure 1:
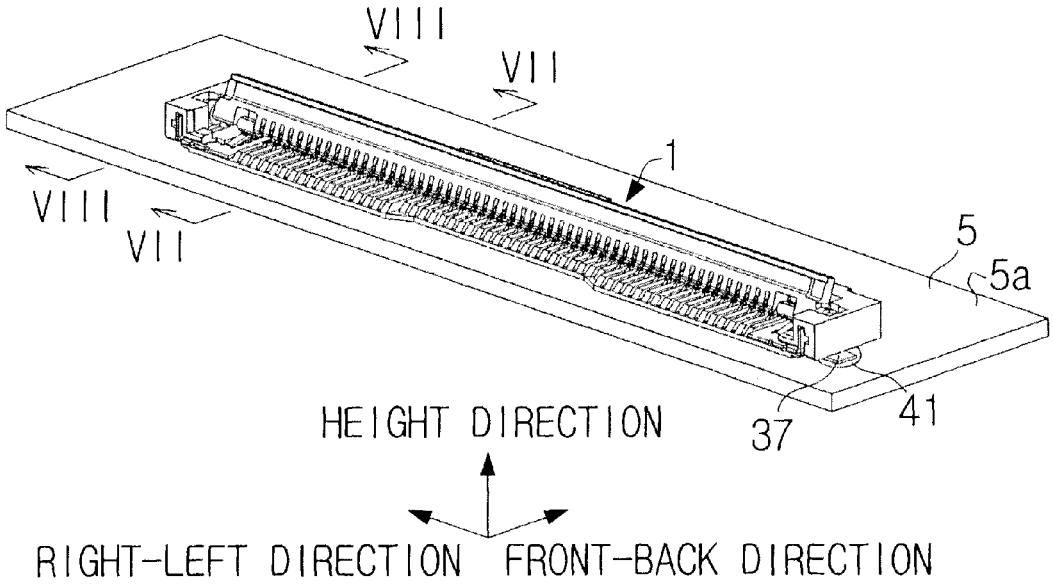
FIG. 1 is a perspective view of a connecter according to a first embodiment of the present invention.
Figure 2:
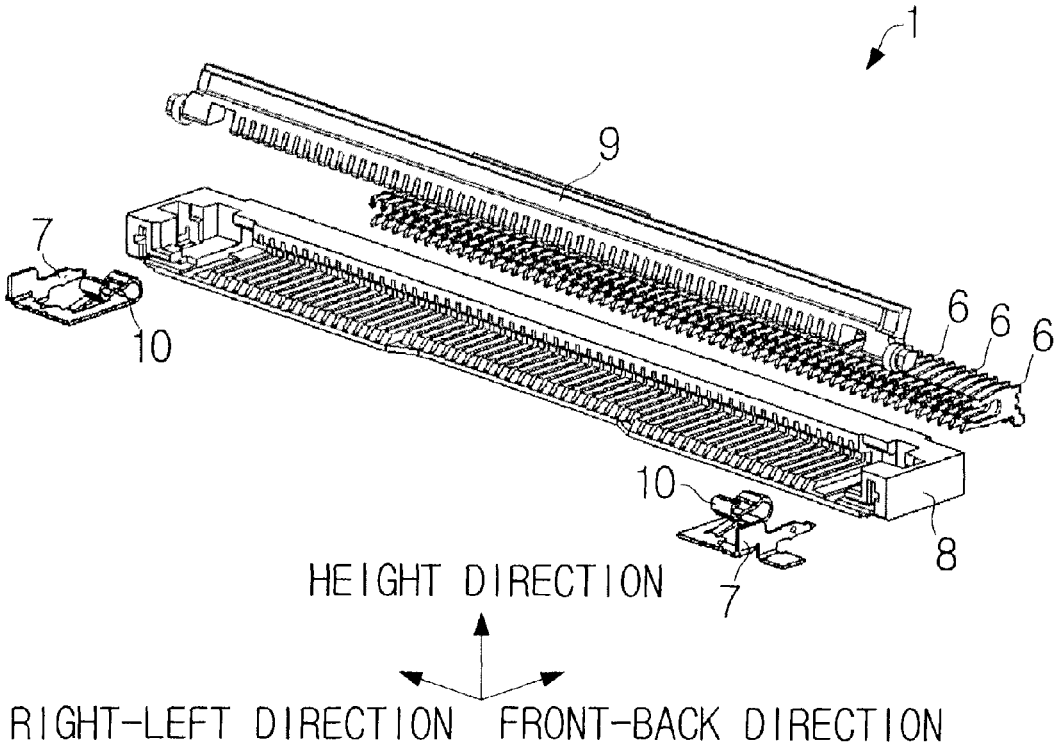
FIG. 2 is an exploded perspective view of the connector according to the first embodiment.
Figure 3:
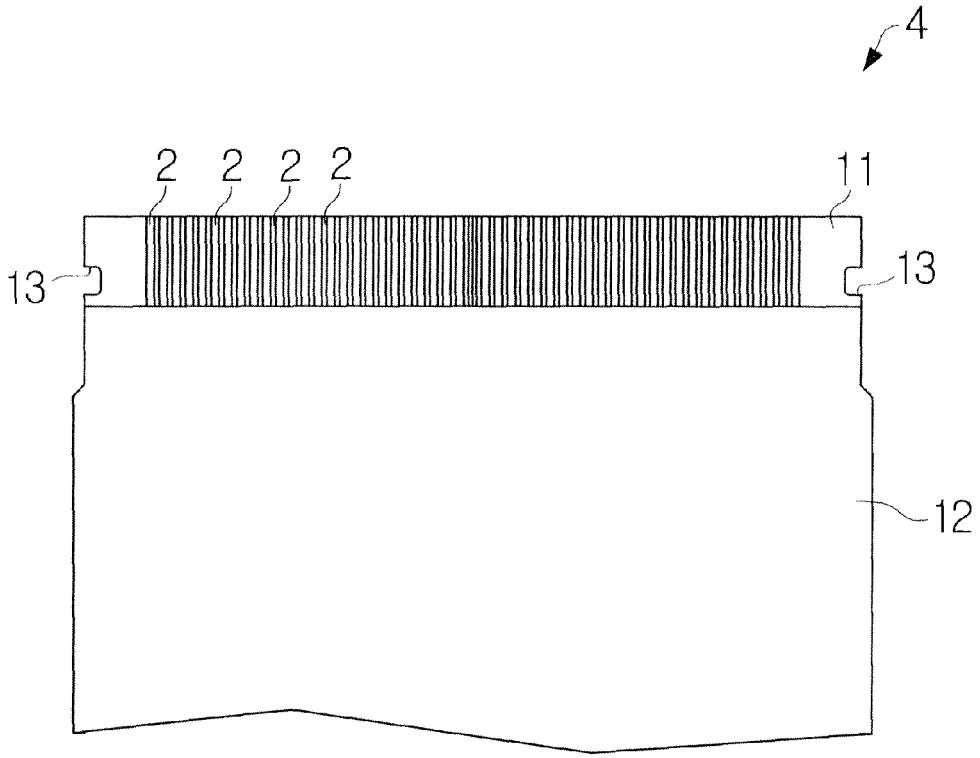
FIG. 3 is a plan view of an FFC according to the first embodiment.
Figure 4:
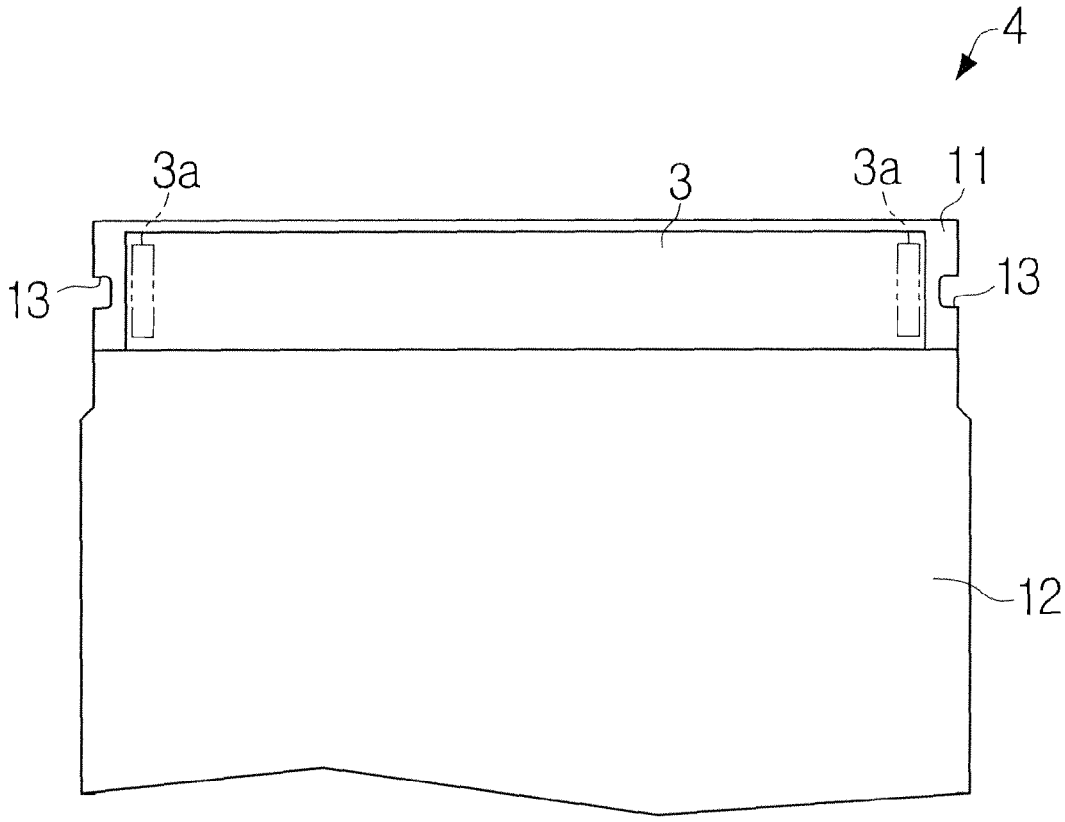
FIG. 4 is a bottom view of the FFC according to the first embodiment.

A connector 1 shown in FIGS. 1 and 2 is used for being mounted on a connector mounting surface 5*a* of a substrate 5 so as to connect an FFC (Flexible Flat Cable) 4 to the substrate 5 shown in FIG. 1. The FFC 4 has a plurality of signal terminals 2 and a single ground terminal 3 as shown in FIGS. 3 and 4. FIG. 1 shows a state where the connector 1 is ready to be connected to the FFC 4.

As shown in FIG. 2, the connector 1 includes a plurality of signal contacts 6, a pair of metal members 7 (assistant fixture), a housing 8, and an actuator 9 (pressurizing member). The plurality of signal contacts 6 respectively come into contact with the signal terminals 2 of the FFC 4, and are arranged in a row as shown in FIG. 2. The metal members 7 each include a ground contact 10. The ground contact 10 comes into contact with the ground terminal 3 of the FFC 4. The plurality of signal contacts 6 and the pair of metal members 7 are held by the housing 8.

Figure 15:
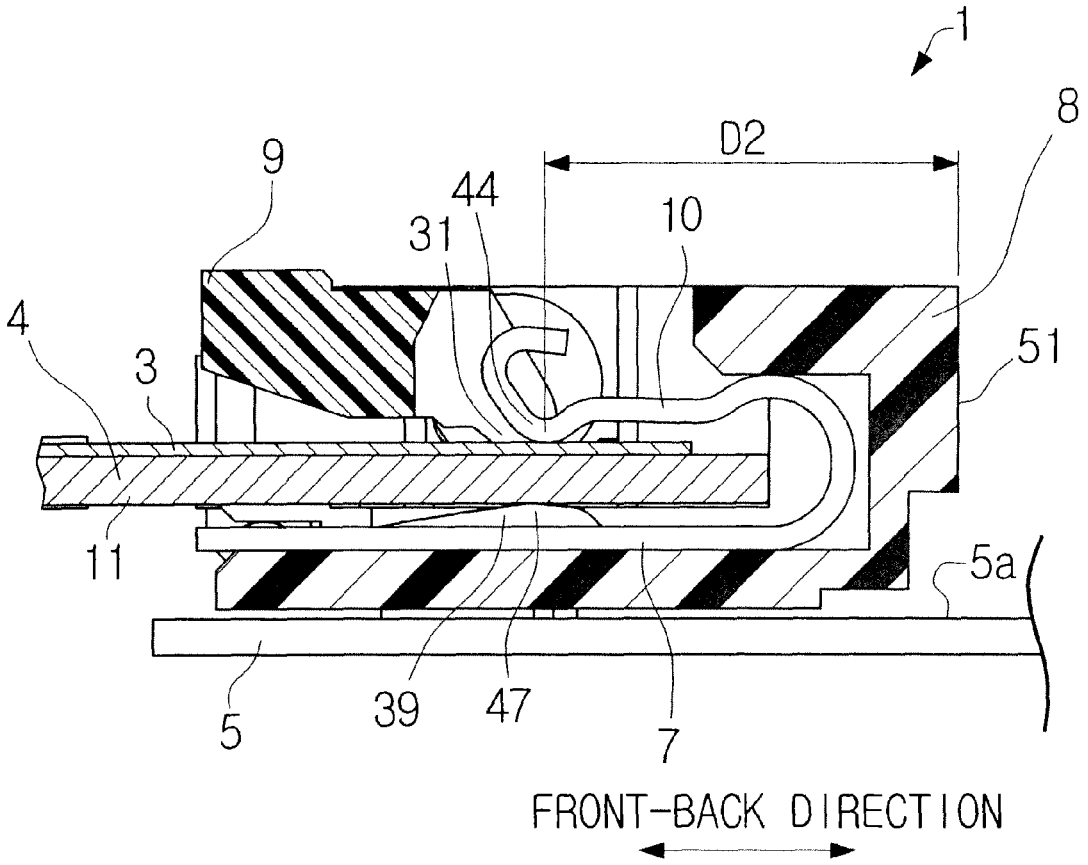
FIG. 15 is an operation explanatory diagram of the connector according to the first embodiment.

For convenience of explanation, the terms "right-left direction", "front-back direction", and "height direction" of the connector 1 are defined below as shown in FIG. 1. The term "right-left direction" refers to a direction in which the plurality of signal contacts 6 are arranged as shown in FIG. 2. The term "front-back direction" refers to a direction in which the FFC 4 is inserted into or removed from the connector 1. In this embodiment, the "front-back direction" (the direction in which the FFC 4 is inserted into or removed from the connector 1) indicates the plane direction of the connector mounting surface 5*a* of the substrate 5 as shown in FIG. 15, and corresponds to the direction perpendicular to the "right-left direction". The term "height direction" refers to a direction perpendicular to the connector mounting surface 5*a* of the substrate 5 shown in FIG. 1.

Figure 18:
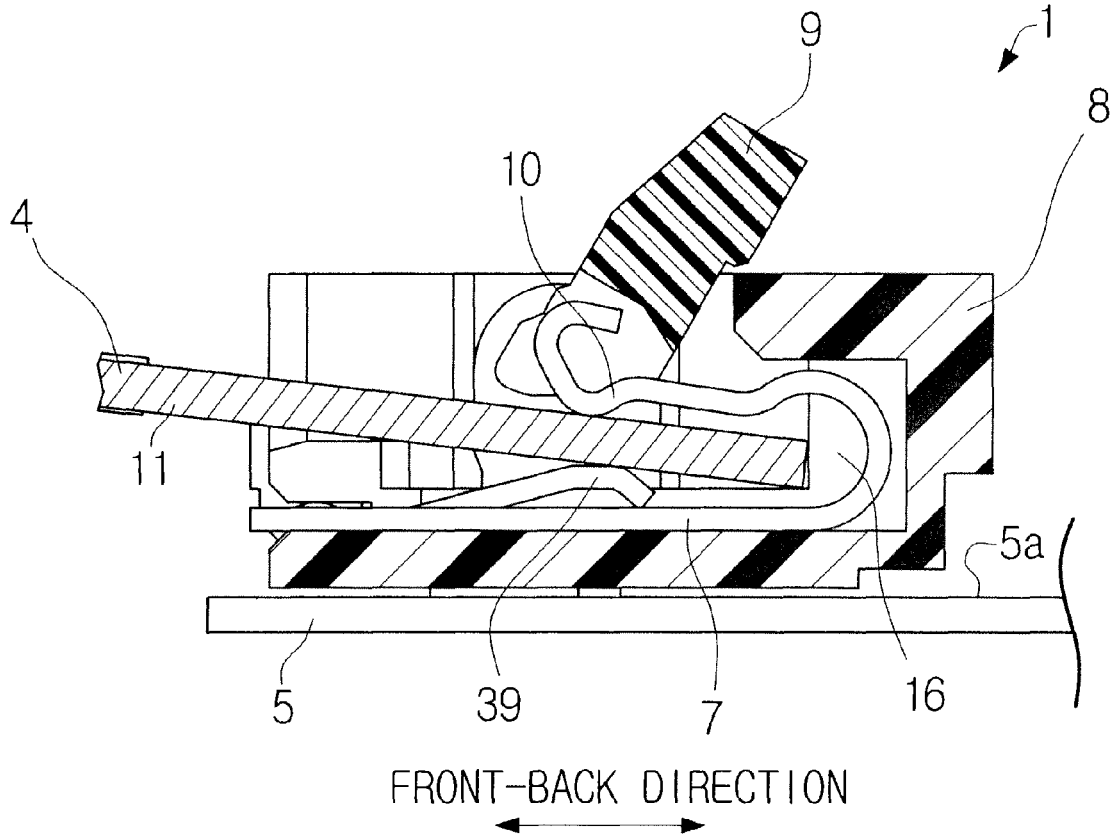
FIG. 18 is an operation explanatory diagram of a connector.

In the "right-left direction", a direction that approaches the center in the right-left direction of the connector 1 is defined as "center approaching direction", and a direction that is spaced apart from the center in the right-left direction of the connector is defined as "center spaced-apart direction". In the "front-back direction", a direction in which the FFC 4 is inserted into the connector 1 is defined as "insertion direction", and a direction in which the FFC 4 is removed from the connector 1 is defined as "removal direction". Strictly speaking, as shown in FIG. 18, the "insertion direction" (or "removal direction") has a slight angle with respect to the plane direction of the connector mounting surface 5*a* of the substrate 5. In the definition of the "insertion direction" and "removal direction", however, such an angle is ignored. In the "height direction", a direction that is spaced apart from the connector mounting surface 5*a* of the substrate 5 is defined as "substrate spaced-apart direction", and a direction that approaches the connector mounting surface 5*a* of the substrate 5 is defined as "substrate approaching direction".

The term "depth" herein described refers to the size in the front-back direction of the connector 1.

(FFC 4)

As shown in FIGS. 3 and 4, in this embodiment, the FFC 4 is a shielded FFC in which a laminate of a base polyimide 11, a plurality of flat conductors arranged in parallel, an adhesion layer, and a coverlay is covered with a shield member 12. As shown in FIG. 3, the base polyimide 11 and the plurality of flat conductors are exposed at an end of the FFC 4. The plurality of flat conductors thus exposed constitute the signal terminals 2 described above. Further, at both ends of the exposed base polyimide 11, a pair of notches 13 are formed. Meanwhile, as shown in FIG. 4, the exposed ground terminal 3 is formed on the side opposite to the signal terminals 2 with the base polyimide 11 interposed therebetween. The ground terminal 3 is electrically connected to the shield member 12. Because of the presence of the ground terminal 3, the FFC 4 shown in FIGS. 3 and 4 is called a two-layer FFC. That is, the signal terminals 2 and the ground terminal 3 constitute the two-layer structure. Further, as shown in FIGS. 3 and 4, the signal terminals 2 and the ground terminal 3 are exposed in opposite directions, with the base polyimide 11 interposed therebetween. The ground terminal 3 is formed so as to cover a wide range of the base polyimide 11 in the right-left direction of the FFC 4. When viewed along the direction perpendicular to the plane direction of the FFC 4, the ground terminal 3 has a wide area so as to overlap all the signal terminals 2. The ground terminal 3 overlaps all the signal terminals 2, and is formed with a large width in the right-left direction of the FFC 4. Accordingly, the ground terminal 3 includes a pair of ground terminal non-overlapping portions 3*a* that sandwich all the signal terminals 2 in the direction in which the plurality of signal terminals 2 are arranged.

More specifically, the ground terminal 3 of the FFC 4 is provided separately from the plurality of signal terminals 2. The ground terminal 3 of the FFC 4 indicates a terminal having a conductor path which covers the entire width of the FFC 4 or is approximate to the overall width of the FFC. The ground terminal 3 of the FFC 4 also functions as a ground line, and can exert a shielding effect, an effect of protection against noise, or an impedance matching effect on the signal terminals 2 of the FFC 4.

(Housing 8)

Figure 5:
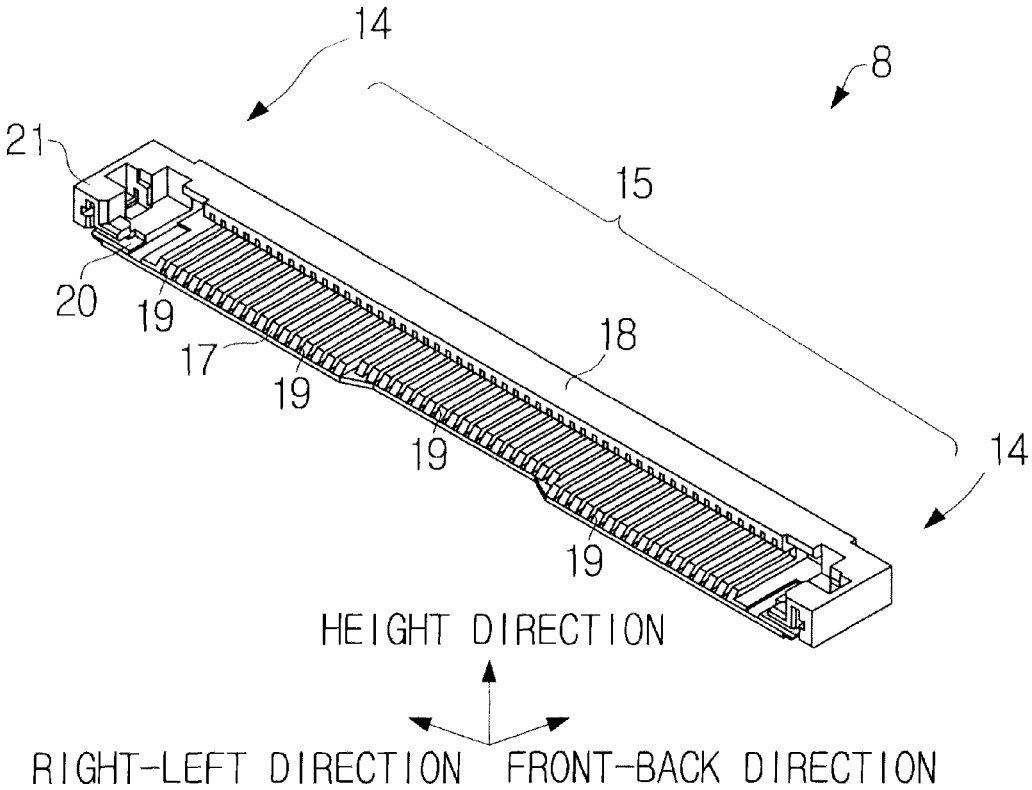
FIG. 5 is a perspective view of a housing according to the first embodiment.
Figure 6:
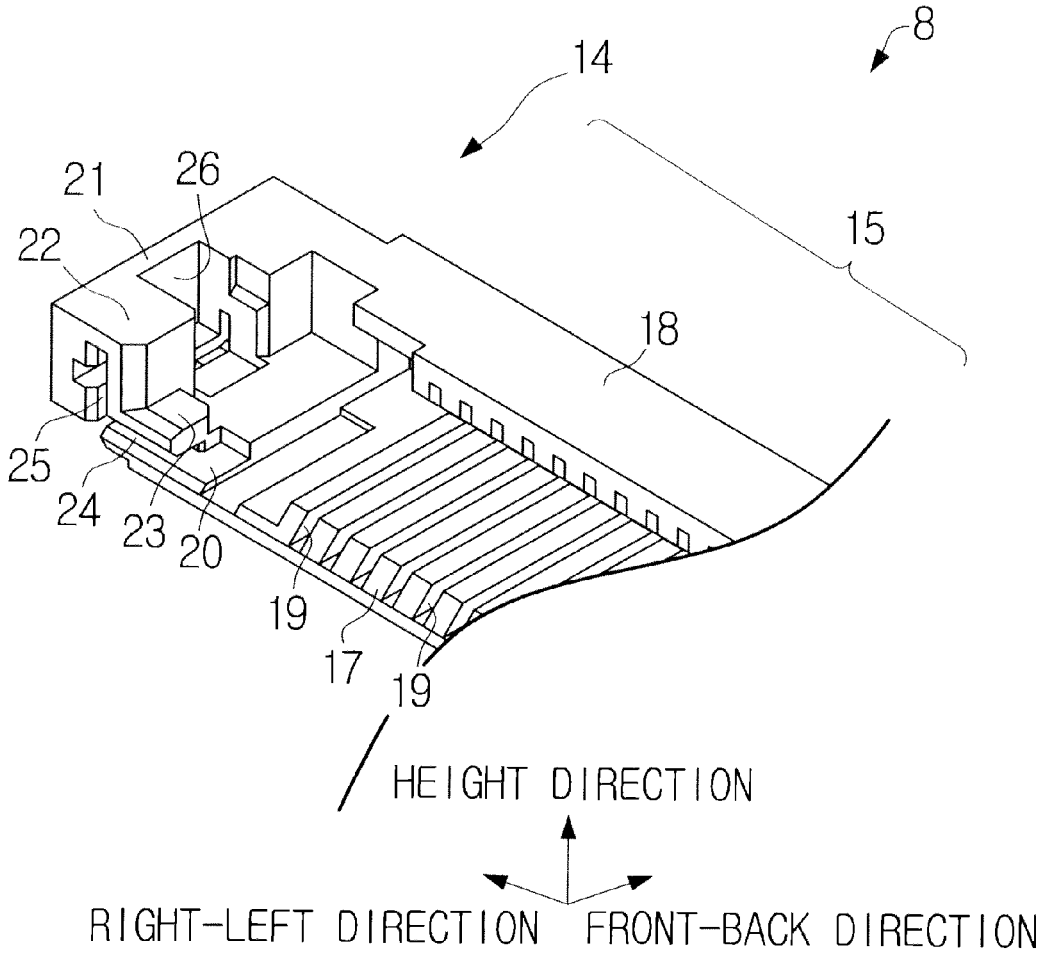
FIG. 6 is a partial enlarged view of FIG. 5 according to the first embodiment.

As shown in FIGS. 5 and 6, the housing 8 includes a pair of housing ends 14 which are ends of the housing 8 in the right-left direction, and a housing central portion 15 which is a central portion of the housing 8 in the right-left direction.

(Housing Central Portion 15)

Figure 7:
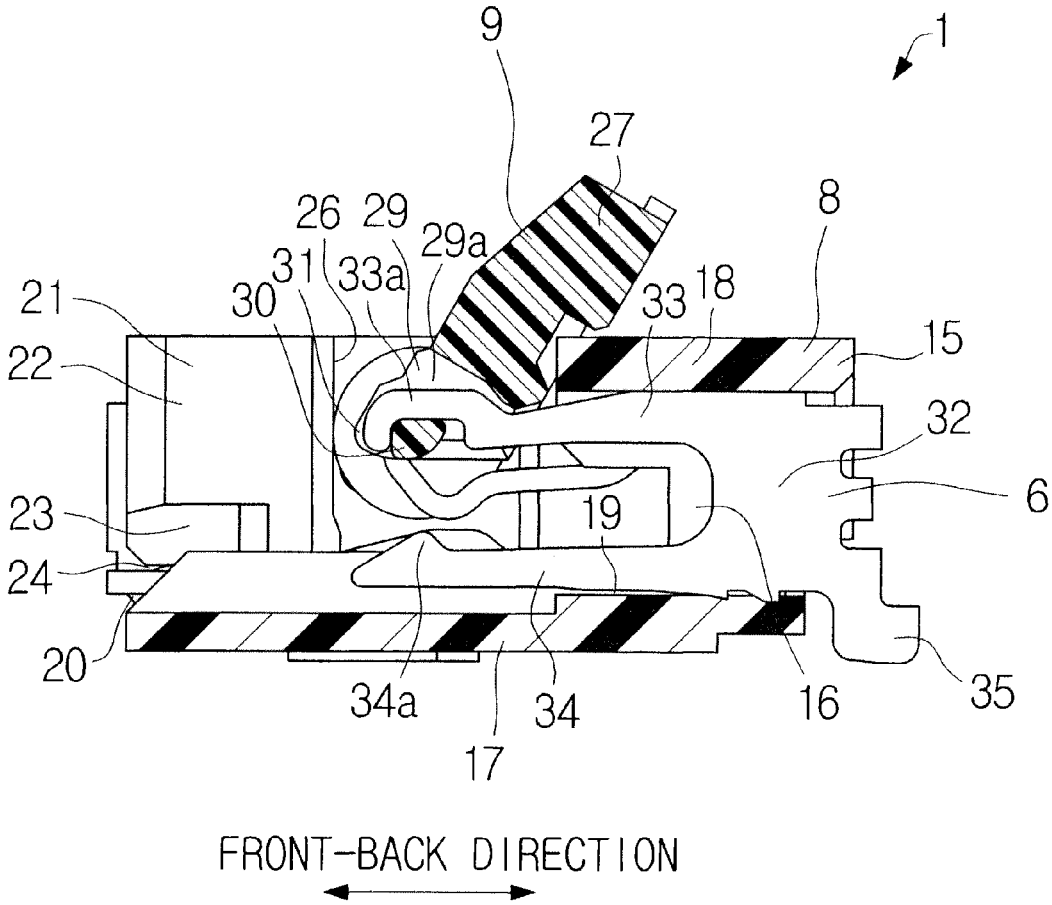
FIG. 7 is a sectional view taken along the line VII-VII of FIG. 1 according to the first embodiment.

The housing central portion 15 is a portion that holds the plurality of signal contacts 6. As shown in FIG. 7, the housing central portion 15 includes a main body 16, a lower projecting portion 17, and an upper projecting portion 18. The lower projecting portion 17 projects from a lower end of the main body 16 in the removal direction. The upper projecting portion 18 projects from an upper end of the main body 16 in the removal direction. In the housing central portion 15, a plurality of signal contact holding chambers 19 are formed at regular pitches in the right-left direction. The plurality of signal contact holding chambers 19 is formed in a penetrating manner in the front-back direction. Each of the signal contacts 6 is press fit and housed within each of the signal contact holding chambers 19, and is held therein. Each of the signal contact holding chambers 19 is formed over the main body 16, the lower projecting portion 17, and the upper projecting portion 18.

(Housing End 14)

The housing end 14 is a portion that holds the metal members 7 and rotatably supports the actuator 9. As shown in FIGS. 5 and 6, the housing end 14 includes a bottom portion 20 and a side wall portion 21. The bottom portion 20 has a small height and is adjacent to the lower projecting portion 17 of the housing central portion 15 in the center spaced-apart direction. The side wall portion 21 has a large height and is adjacent to the bottom portion 20 in the center spaced-apart direction. As shown in FIG. 6, a removal preventing protrusion 23 is formed at a distal end 22 of the side wall portion 21 in the removal direction. The removal preventing protrusion 23 is connected to the distal end 22, and is formed to protrude from the distal end 22 in the center approaching direction. The removal preventing protrusion 23 is fit into the notches 13 (also see FIG. 4) formed in the base polyimide 11 of the FFC 4, thereby preventing unintended removal of the FFC 4 from the connector 1. Between the removal preventing protrusion 23 and the bottom portion 20, a parallel groove 24 is formed. The parallel groove 24 opens in the removal direction, the center approaching direction, and the center spaced-apart direction. In the side wall portion 21, a longitudinal groove 25 is formed. The longitudinal groove 25 opens in the removal direction and the substrate approaching direction. The parallel groove 24 and the longitudinal groove 25 are continuously formed. When the connector 1 is viewed along the insertion direction, the parallel groove 24 and the longitudinal groove 25 form a substantially L-shape. In the side wall portion 21, actuator supporting grooves 26 are formed. The actuator supporting grooves 26 open in the substrate spaced-apart direction and the center approaching direction.

(Actuator 9)

Figure 9:
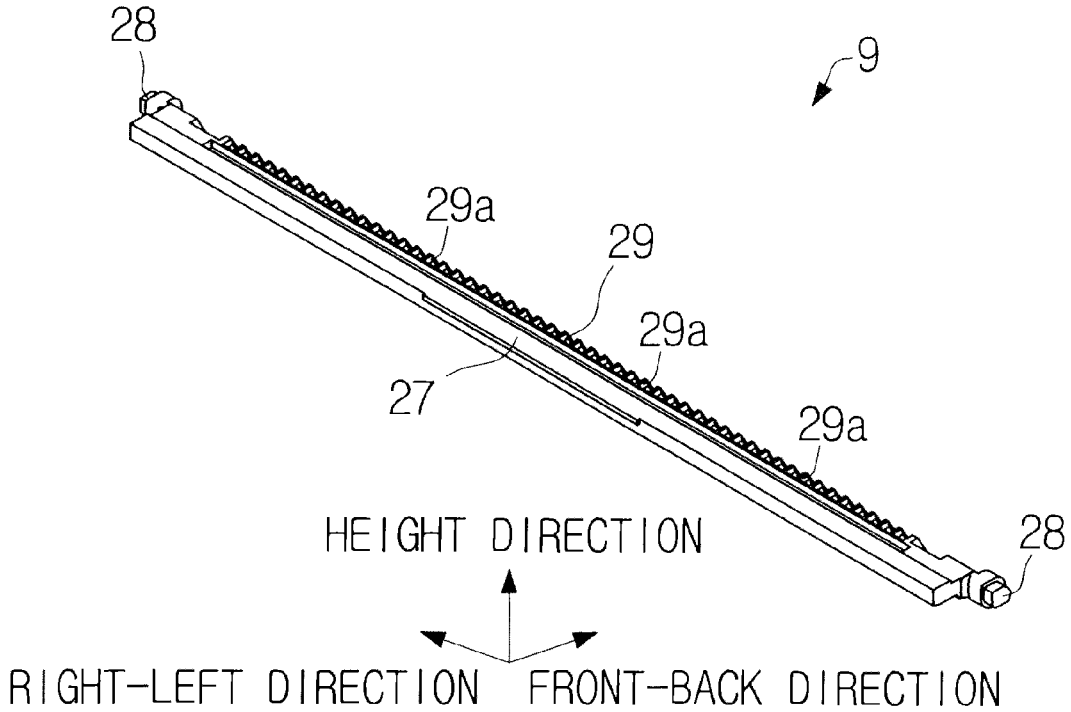
FIG. 9 is a perspective view of an actuator according to the first embodiment.

The actuator 9 is a pressurizing member for bringing the plurality of signal contacts 6 into contact with the plurality of signal terminals 2. As shown in FIG. 9, the actuator 9 includes an actuator body 27 (pressurizing member body), a pair of first shaft portions 28, a comb teeth portion 29, and a plurality of second shaft portions 30 (also see FIG. 7). A plurality of comb teeth 29*a* constituting the comb teeth portion 29, and the second shaft portions 30 shown in FIG. 7 are alternately arranged in the right-left direction. As shown in FIG. 9, the pair of first shaft portions 28 are formed at positions where the plurality of comb teeth 29*a* and the plurality of second shaft portions 30 are sandwiched in the right-left direction. The first shaft portions 28 are formed substantially coaxially with the second shaft portions 30. Further, the comb teeth portion 29 is connected with the actuator body 27 serving as an operating lever for rotating the comb teeth portion 29 with the first shaft portions 28 or the second shaft portions 30 as a center. As shown in FIG. 7, each of the comb teeth 29*a* of the comb teeth portion 29 has a pressing portion 31 which presses the FFC 4 in the substrate approaching direction when the actuator body 27 falls down.

(Signal Contact 6)

The signal contacts 6 are used for electrically connecting the signal terminals 2 of the FFC 4 to a signal land (not shown) formed on the connector mounting surface 5*a* of the substrate 5. As shown in FIG. 7, each of the signal contacts 6 is a so-called ZIF (Zero Insertion Force) connector including a signal contact body 32, a hook 33, a contact portion 34, and a lead 35. The hook 33 inhibits removal of the actuator 9 from the housing 8. The hook 33 is connected to an upper end of the signal contact body 32, and is formed to project from the signal contact body 32 in the removal direction. At a distal end of the hook 33, a hook portion 33*a* that opens in the substrate approaching direction is formed. The contact portion 34 comes into contact with the signal terminals 2 of the FFC 4. The contact portion 34 is connected to a lower end of the signal contact body 32, and is formed to project from the signal contact body 32 in the removal direction. At a distal end of the contact portion 34, a protrusion 34*a* (signal contact portion) that protrudes in the substrate spaced-apart direction is formed. The lead 35 is soldered to a contact land (not shown) formed on the connector mounting surface 5*a* of the substrate 5. The lead 35 is connected to a lower end of the signal contact body 32, and is formed to project from the signal contact body 32 in the insertion direction.

(Metal Member 7)

As shown in FIG. 2, the pair of metal members 7 have such a shape that one of the metal members 7 is symmetric in the right-left direction with respect to the other of the metal members 7. Accordingly, the pair of metal members 7 are described without distinguishing these members from each other. The metal member 7 shown on the back left side of FIG. 2 corresponds to the metal members 7 shown in FIG. 10. The metal member 7 shown on the front right side of FIG. 2 corresponds to the metal members 7 shown in FIG. 11.

Figure 10:
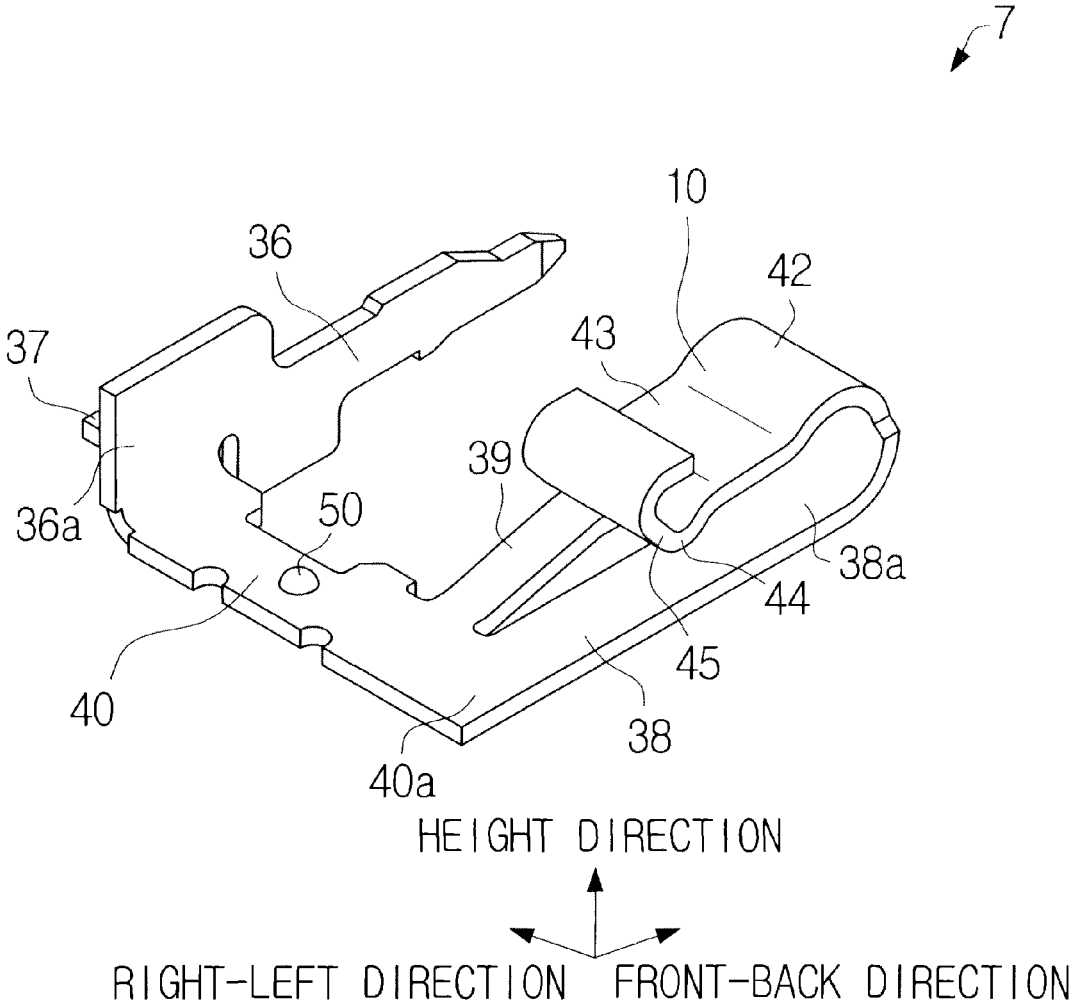
FIG. 10 is a perspective view of one metal member according to the first embodiment.
Figure 11:
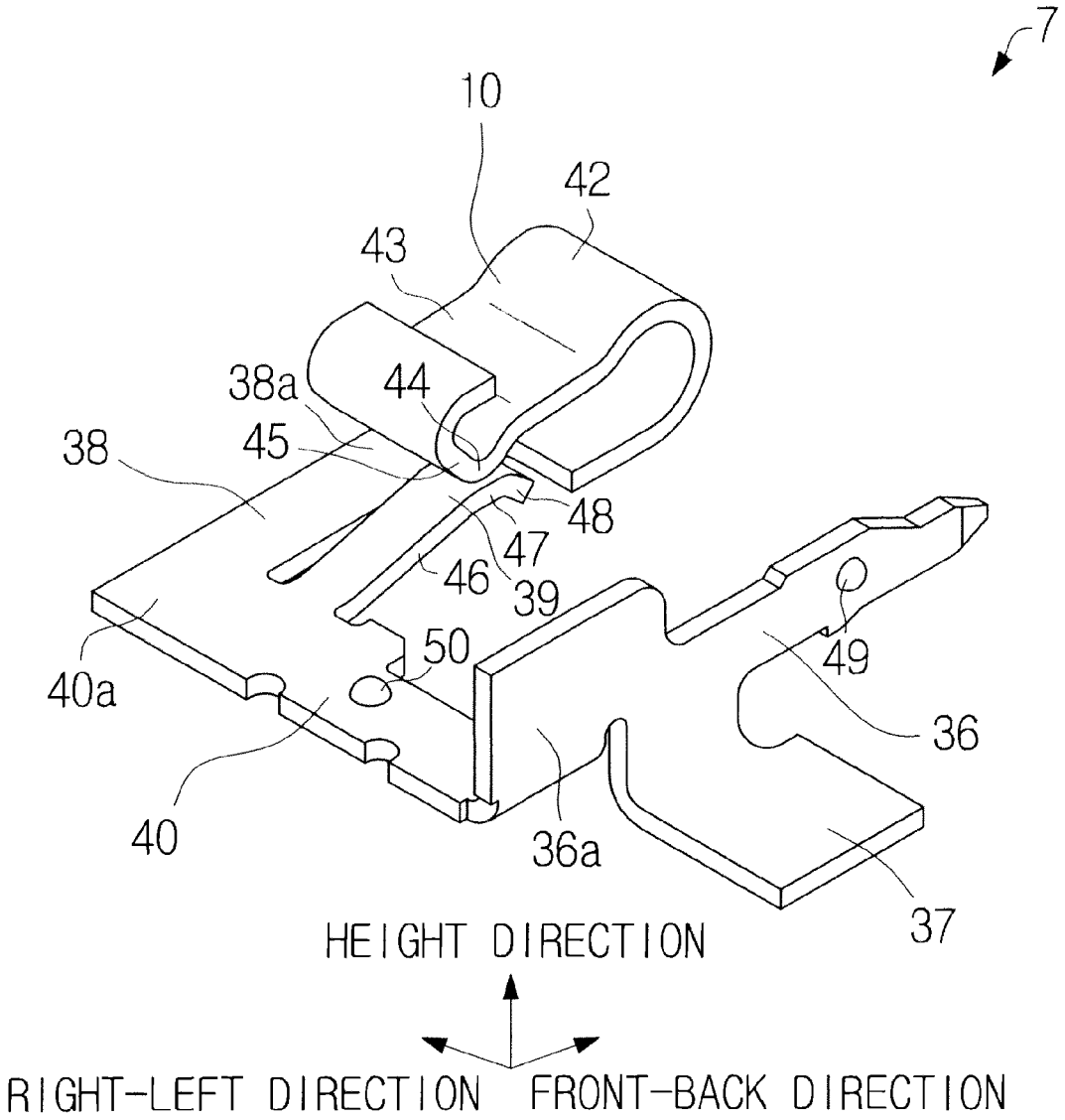
FIG. 11 is a perspective view of the other metal member according to the first embodiment.

As shown in FIGS. 10 and 11, each of the metal members 7 includes a housing insertion portion 36, a soldering terminal portion 37, the ground contact 10, a ground contact supporting portion 38, a plate spring 39, and a coupling portion 40. The metal members 7 are integrally formed by punching out a thin metal sheet into a predetermined shape and folding the metal sheet.

The housing insertion portion 36 is press fit into the longitudinal groove 25 formed in the side wall portion 21 at the housing end 14 of the housing 8 shown in FIG. 6, thereby fixing the metal members 7 to the housing 8. The housing insertion portion 36 has a shape smoothly tapered in the insertion direction as shown in FIGS. 10 and 11.

The soldering terminal portion 37 is soldered to a grounding land 41 (see FIG. 1) formed on the connector mounting surface 5*a* of the substrate 5, thereby fixing the metal members 7 to the substrate 5 and allowing the metal members 7 to electrically connect with the grounding land 41. The soldering terminal portion 37 is connected to a lower end of a middle portion in the longitudinal direction of the housing insertion portion 36, and is formed to project in the center spaced-apart direction.

The coupling portion 40 is press fit into the parallel groove 24 of the housing 8 shown in FIG. 6, thereby fixing the metal members 7 to the housing 8 and supporting the ground contact 10 and the plate spring 39. The coupling portion 40 is connected to a lower end of a proximal end 36*a* which is an end in the removal direction of the housing insertion portion 36, and is formed to project in the center approaching direction. As shown in FIGS. 10 and 11, the coupling portion 40 is connected with the ground contact supporting portion 38 and the plate spring 39.

The ground contact supporting portion 38 allows the coupling portion 40 to support the ground contact 10. In other words, the ground contact 10 is supported by the coupling portion 40 via the ground contact supporting portion 38. As shown in FIG. 10, the ground contact supporting portion 38 is connected to a distal end 40*a* in the center approaching direction of the coupling portion 40, and is formed to project from the distal end 40*a* in the insertion direction. The ground contact 10 is connected to a distal end 38*a* in the insertion direction of the ground contact supporting portion 38.

The ground contact 10 includes a curved portion 42, a horizontal portion 43, a contact portion 44 (ground contact portion), and a guide portion 45. The curved portion 42 is connected to the distal end 38*a* of the ground contact supporting portion 38. The curved portion 42 is curved in the substrate spaced-apart direction and is further curved so as to be folded back toward the distal end 40*a* of the coupling portion 40. The horizontal portion 43, the contact portion 44, and the guide portion 45 are integrally and continuously formed in this order from the curved portion 42 toward the distal end 40*a* of the coupling portion 40. The horizontal portion 43 is connected to the curved portion 42, and is formed in parallel to the ground contact supporting portion 38. The contact portion 44 is connected to the horizontal portion 43, and is formed to be slightly recessed in the substrate approaching direction. The guide portion 45 is connected to the contact portion 44, and is formed to be inclined in the substrate spaced-apart direction.

When the FFC 4 is inserted into the connector 1, the plate spring 39 (contact pressure generating portion, pressing member) generates a contact pressure between the ground terminal 3 of the FFC 4 and the ground contact 10. Specifically, the plate spring 39 is provided on the opposite side to the ground contact 10 with the FFC 4 interposed therebetween, and is adapted to press the ground terminal 3 of the FFC 4 against the ground contact 10. As shown in FIG. 11, the plate spring 39 is connected to the vicinity of the distal end 40*a* of the coupling portion 40, and is formed to project from the coupling portion 40 in the insertion direction. The plate spring 39 includes a guide portion 46, a pressure-contact portion 47, and a receding portion 48. The guide portion 46, the pressure-contact portion 47, and the receding portion 48 are integrally and continuously formed in this order in the direction apart from the coupling portion 40. The guide portion 46 is formed to be inclined in the substrate spaced-apart direction as advancing in the insertion direction. The guide portion 46 of the plate spring 39 has a guide structure that is tapered in the insertion direction in cooperation with the guide portion 45 of the ground contact 10. This guide structure allows the FFC 4 to be smoothly inserted between the contact portion 44 of the ground contact 10 and the pressure-contact portion 47 of the plate spring 39. The pressure-contact portion 47 is formed at a position opposed to the contact portion 44 of the ground contact 10 in the height direction. The receding portion 48 is formed to be inclined in the substrate approaching direction as advancing in the insertion direction. Due to the presence of the receding portion 48, the plate spring 39 is formed into a curved shape which is convex in the substrate spaced-apart direction with the pressure-contact portion 47 as an apex.

Additionally, as shown in FIG. 11, the housing insertion portion 36 is provided with a first hemispherical portion 49 which projects in a hemispherical shape in the center spaced-apart direction. The first hemispherical portion 49 presses an insertion surface (i.e., one inner wall surface of the longitudinal groove 25) of the housing 8 when the metal members 7 are inserted into the housing 8. As a result, the surface opposite to the surface on which the first hemispherical portion 49 is formed is pressed against an insertion surface (the other inner wall surface of the longitudinal groove 25) of the housing 8, thereby positioning the metal members 7 with respect to the housing 8. Similarly, the coupling portion 40 is provided with a second hemispherical portion 50 which projects in a hemispherical shape in the substrate spaced-apart direction. Also the second hemispherical portion 50 has technical advantages substantially the same as those of the first hemispherical portion 49.

In this embodiment, the ground contact 10 and the plate spring 39 are provided to form a temporary holding structure. Though the temporary holding structure is held in the housing 8 via the coupling portion 40, the temporary holding structure has a low rigidity against torsion of the coupling portion 40 itself. Accordingly, the position of the temporary holding structure relative to the housing 8 can be changed.

Further, in this embodiment, the temporary holding structure and the actuator 9 are independent from each other in operation. In other words, the temporary holding structure and the actuator 9 do not physically interfere with each other.

Furthermore, in this embodiment, as is seen from FIGS. 1, 2, 7, and 8, a pair of temporary holding structures are provided at positions where the plurality of signal contacts 6 are sandwiched in the direction in which the plurality of signal contacts 6 are arranged.

Moreover, in this embodiment, the pair of temporary holding structures (a part of the metal members 7) are separately formed as shown in FIG. 2.

Next, the assembly of the connector 1 will be briefly described.

From the state shown in FIG. 2, the actuator 9 is first attached to the housing 8. At this time, the first shaft portions 28 of the actuator 9 shown in FIG. 9 are housed in the actuator supporting grooves 26 of the side wall portions 21 of the housing 8 shown in FIG. 6. Next, the actuator 9 is tilted to a substantially parallel position relative to the housing 8 (see FIG. 12). At this time, attention should be paid to ensure that the pressing portion 31 of the comb teeth portion 29 of the actuator 9 is directed in the substrate approaching direction.

Figure 12:
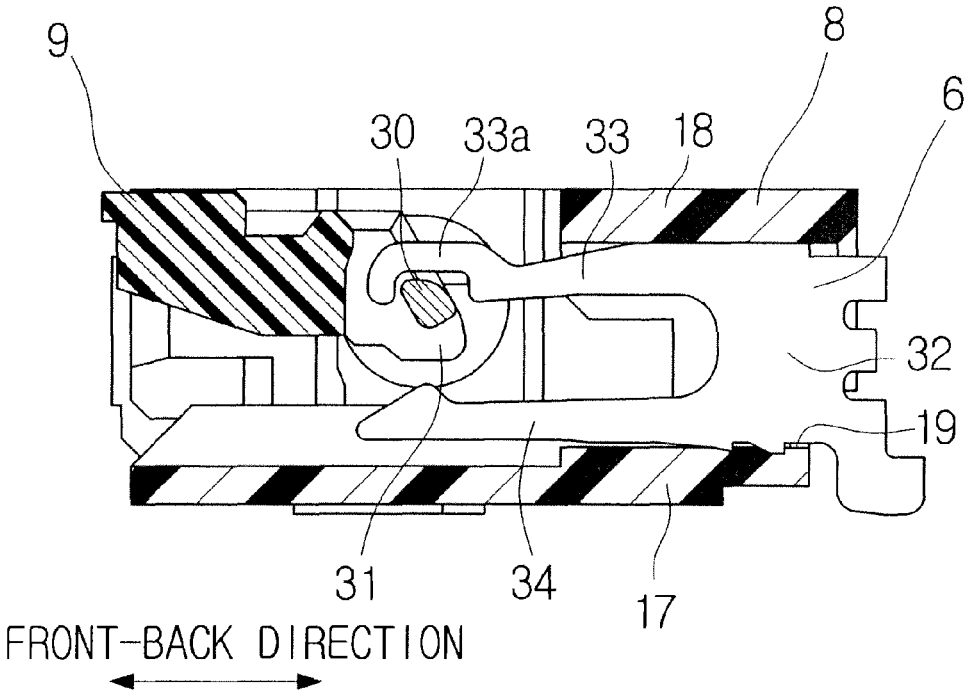
FIG. 12 is an assembly illustration of the connector according to the first embodiment.

Next, as shown in FIG. 12, the plurality of signal contacts 6 are press fit into the plurality of signal contact holding chambers 19 of the housing 8 in the removal direction. At this time, the signal contacts 6 are press fit into the signal contact holding chambers 19 in such a manner that the contact portion 34 of each of the signal contacts 6 is positioned on the side of the lower projecting portion 17 of the housing 8 and the hook 33 of each of the signal contacts 6 is positioned on the side of the upper projecting portion 18 of the housing 8, with the contact portion 34 and the hook 33 as a leading end. Upon the press fitting, the hook portion 33*a* of the hook 33 of each of the signal contacts 6 strides over the second shaft portion 30 of the actuator 9. As a result, the actuator 9 is inhibited from being removed from the housing 8 in the substrate spaced-apart direction via the second shaft portion 30, the hook portion 33*a*, the hook 33, the signal contact body 32, and the upper projecting portion 18 in this order. Similarly, the actuator 9 is inhibited from being removed from the housing 8 in the front-back direction and the substrate approaching direction via the first shaft portion 28 and the side wall portion 21 in this order. In short, in this state, the actuator 9 is rotatably supported by the housing 8 via the first shaft portion 28, the second shaft portion 30, and the signal contact 6.

Figure 8:
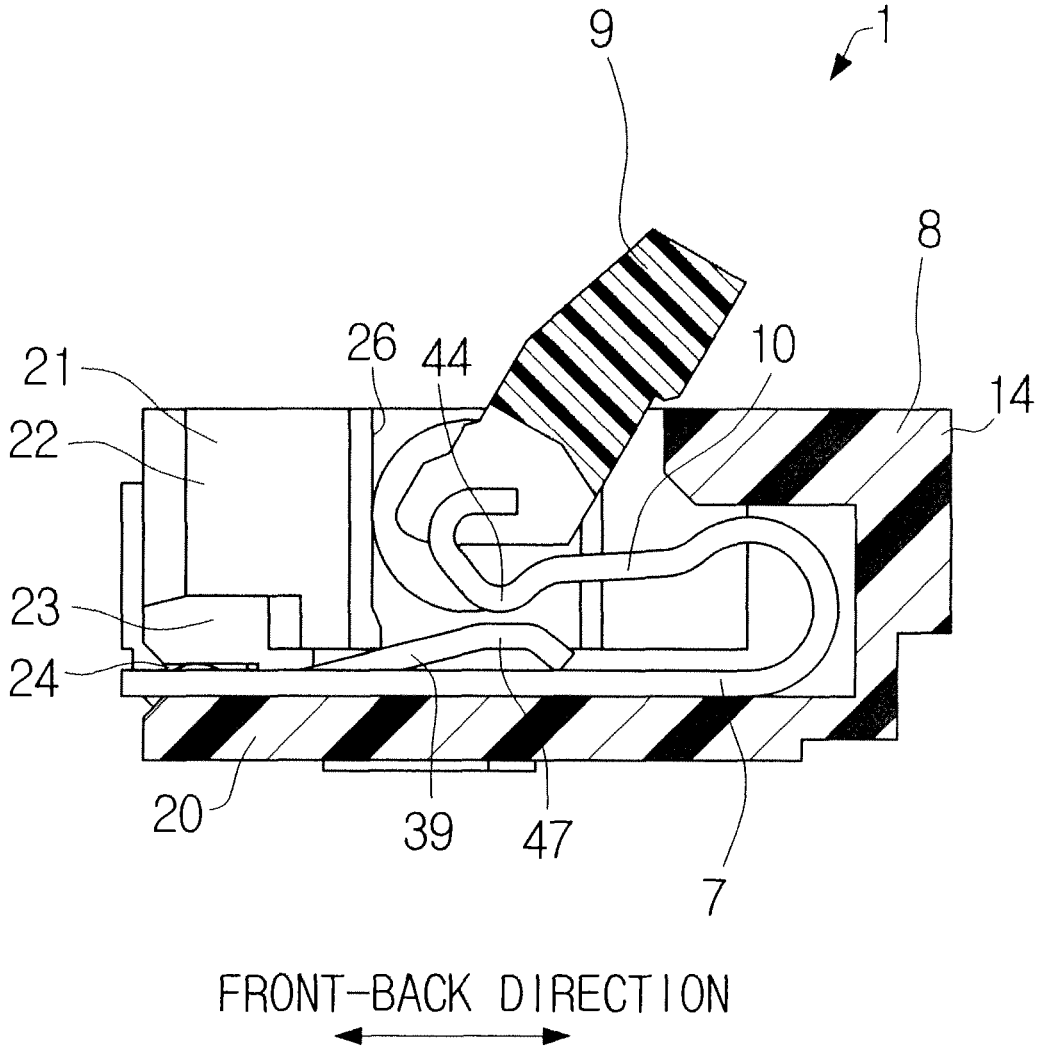
FIG. 8 is a sectional view taken along the line VIII-VIII of FIG. 1 according to first embodiment.

Then, after the actuator 9 is changed to an upright position (see FIG. 8), the pair of metal members 7 are respectively press fit into the pair of housing ends 14 of the housing 8 in the insertion direction. Specifically, the housing insertion portion 36 shown in FIG. 10 is press fit into the longitudinal groove 25 shown in FIG. 6, and the coupling portion 40 shown in FIG. 10 is press fit into the parallel groove 24 shown in FIG. 6. At this time, the soldering terminal portion 37 shown in FIG. 10 is exposed on the side of the substrate 5 at the side wall portion 21 shown in FIG. 6. FIGS. 7 and 8 each show a state where the assembly of the connector 1 is completed.

Next, the usage of the connector 1 will be described.

First, as shown in FIG. 1, the soldering terminal portion 37 for the metal members 7 of the connector 1 is soldered to the grounding land 41 of the connector mounting surface 5*a* of the substrate 5. Similarly, the lead 35 of each of the signal contacts 6 of the connector 1 shown in FIG. 7 is soldered to a signal land (not shown) formed on the connector mounting surface 5*a*of the substrate 5. As shown in FIG. 7, the actuator 9 is changed to the upright position in advance. This allows the connector 1 to be ready for connecting the FFC 4.

Figure 13:
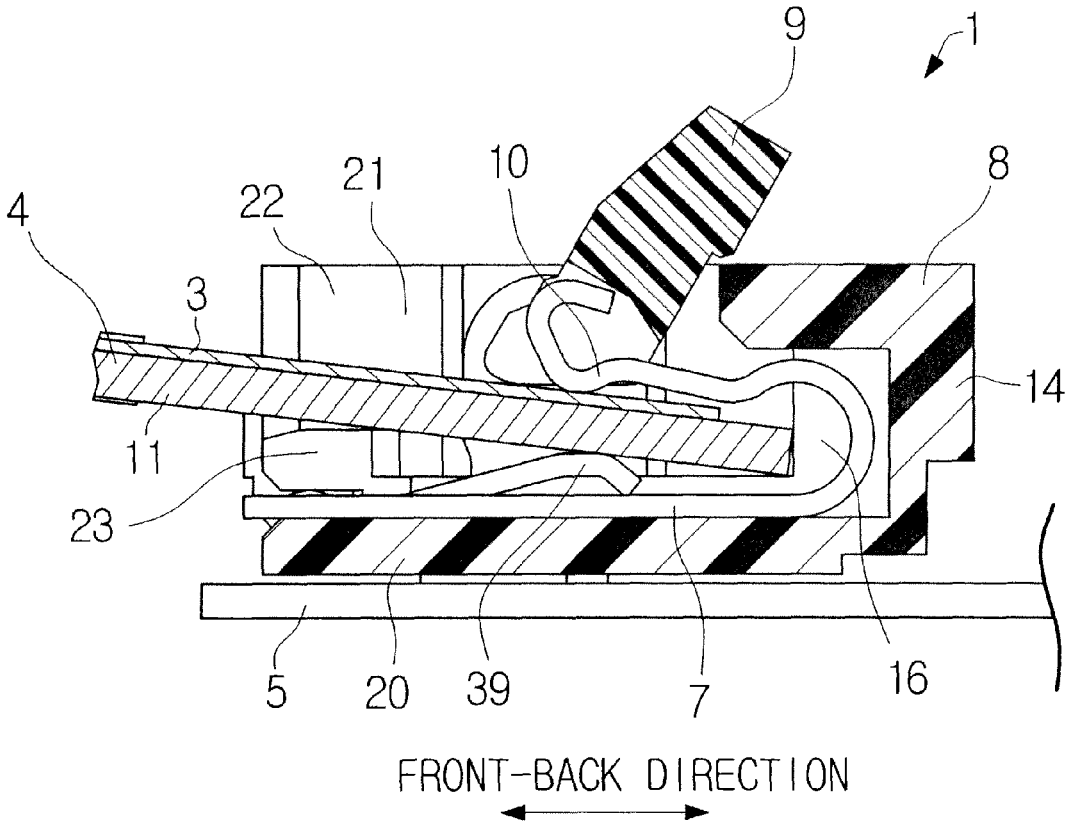
FIG. 13 is an operation explanatory diagram of the connector according to the first embodiment.

Next, as shown in FIG. 13, the FFC 4 is inserted into the connector 1. Specifically, the FFC 4 is inserted between the contact portion 34 and the hook 33 of the signal contact 6 shown in FIG. 7. In other words, the FFC 4 is inserted between the ground contact 10 and the plate spring 39 which constitute the temporary holding structure for the metal members 7 shown in FIG. 8. As described above, each of the signal contacts 6 is a so-called ZIF connector. In other words, as shown in FIG. 7, the gap between the hook 33 and the contact portion 34 of the signal contact 6 is set to be greater than the thickness of the FFC 4 in a no load state of the signal contact 6. Accordingly, even if the FFC 4 comes into contact with the signal contact 6 during the insertion, no resistance force is generated with respect to the insertion. Meanwhile, as shown in FIG. 8, the gap between the ground contact 10 and the plate spring 39 is set to have a smaller thickness than the FFC in a no load state of the metal member 7. More specifically, the gap between the contact portion 44 of the ground contact 10 and the pressure-contact portion 47 of the plate spring 39 is set to smaller than the thickness of the FFC 4 in the no load state of the metal member 7 before the FFC 4 is inserted. Therefore, during the insertion, the FFC 4 comes into contact with the ground contact 10 and the plate spring 39 of the metal members 7 with a predetermined contact pressure, and friction is generated between the ground contact 10 and the plate spring 39, which causes a resistance force against the insertion. In short, during the insertion, the FFC 4 receives no resistance force from the signal contact 6, but receives a resistance force from the ground contact 10 and the plate spring 39 which constitute the temporary holding structure. The resistance force applied from the temporary holding structure is also generated when the FFC 4 is to be removed from the connector 1. In view of the foregoing, it can be said that the FFC 4 is temporarily held by the connector 1 due to the resistance force generated by the temporary holding structure.

By the insertion, the ground terminal non-overlapping portions 3*a* (see FIG. 4) of the ground terminal 3 of the FFC 4 and the contact portions 44 of the ground contacts 10 come into contact with each other with a predetermined contact pressure.

Note that as shown in FIG. 13, attention should be paid to ensure that the FFC 4 is inserted into the connector 1 to be slightly inclined downward so as to prevent the FFC 4 from physically interfering with the removal preventing protrusion 23 at the housing end 14 of the housing 8. Similarly, it is checked whether the front and back surfaces of FFC 4 are properly positioned so that the ground terminal 3 of the FFC 4 is directed in the substrate spaced-apart direction.

Figure 14:
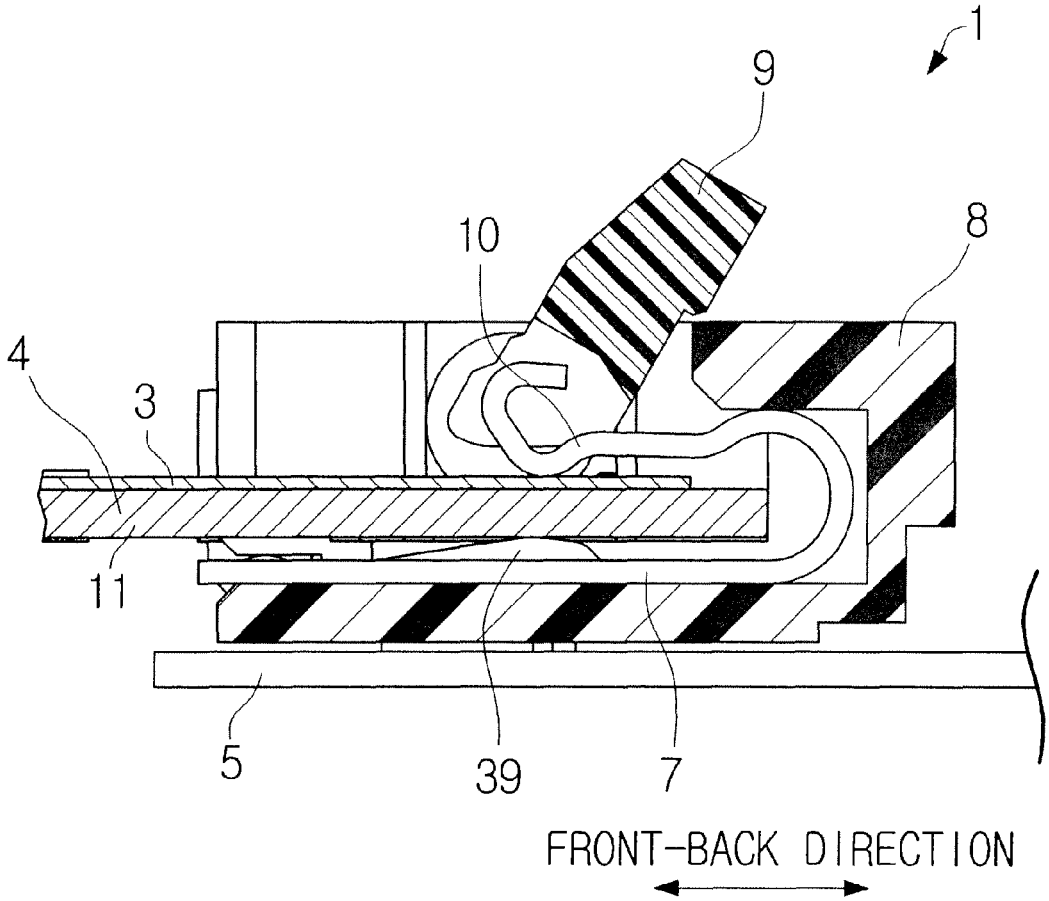
FIG. 14 is an operation explanatory diagram of the connector according to the first embodiment.

Then, after the FFC 4 is inserted in the connector 1 until being abutted against the main body 16 of the housing 8 as shown in FIG. 13, the FFC 4 is changed to a horizontal position with respect to the substrate 5 as shown in FIG. 14. As a result, the removal preventing protrusion 23 at the housing end 14 of the housing 8 shown in FIG. 6 is fit into the notch 13 of the FFC 4 shown in FIG. 4 with an allowance, thereby strongly inhibiting the FFC 4 from being removed from the connector 1. In the structure in which the removal preventing protrusion 23 is fit into the notch 13 with an allowance, if the temporary holding structure as described above is not present, the notch 13 is easily removed from the removal preventing protrusion 23. Accordingly, it is substantially impossible to inhibit the FFC 4 from being removed from the connector 1. In this regard, it can be said that a removal preventing structure using the notch 13 and the removal preventing protrusion 23 is achieved only when the temporary holding structure is present.

Figure 16:
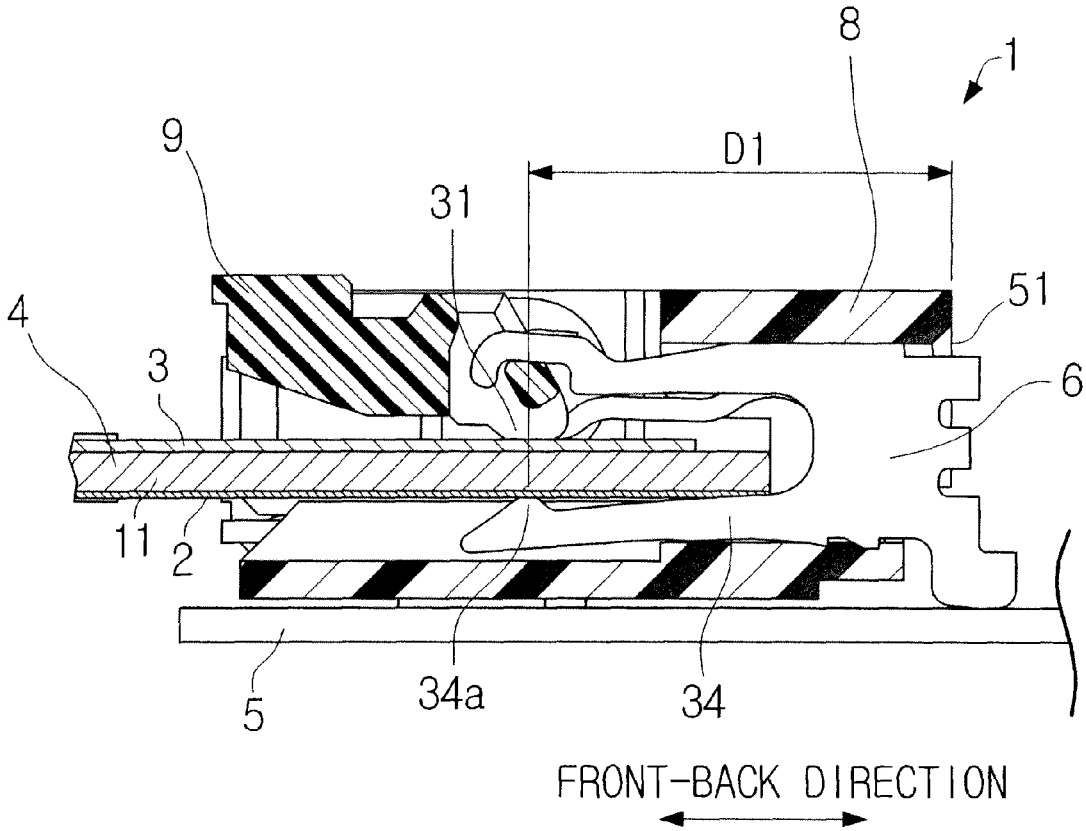
FIG. 16 is an operation explanatory diagram of the connector according to the first embodiment.

Next, the actuator 9 shown in FIG. 14 is tilted in the removal direction to a substantially horizontal position as shown in FIG. 15. Then, as shown in FIG. 16, the FFC 4 is pressed in the substrate approaching direction by the pressing portion 31 of the actuator 9, so that the signal terminal 2 of the FFC 4 and the protrusion 34*a* of the contact portion 34 of the signal contact 6 are brought into strong contact with each other. On the other hand, the temporary holding structure and the actuator 9 are independent from each other in operation. Accordingly, as is obvious from the comparison between FIGS. 14 and 15, the temporary holding structure hardly changes before and after the change of the actuator 9 to the substantially horizontal position. In this case, however, when the FFC 4 is pressed in the substrate approaching direction by the pressing portion 31 of the comb teeth portion 29 of the actuator 9, the temporary holding structure holding the FFC 4 indirectly changes the position slightly.

The usage of the connector 1 has been described above. Next, significant features of the connector 1 will be described in detail.

The terms "first distance D1" and "second distance D2" are herein defined. First, a reference for defining the terms "first distance D1" and "second distance D2" is described with reference to FIGS. 15 and 16. That is, as shown in FIGS. 15 and 16, in a side cross-sectional view viewed along the right-left direction, which is a direction in which the plurality of signal contacts 6 are arranged, an end of the housing 8 in the front-back direction, which is a direction in which the FFC 4 is inserted into or removed from the connector 1, is set as the reference. In this embodiment, as shown in FIGS. 15 and 16, a back surface 51 of the housing 8 is employed as the end of the housing 8 in the front-back direction, i.e., as the reference.

In view of the above, the first distance D1 is defined as a distance in the front-back direction to a contact point of the signal contact 6 with respect to the signal terminals 2 with the back surface 51 of the housing 8 as the reference, as shown in FIG. 16. In this embodiment, the contact point of the signal contact 6 with respect to the signal terminals 2 corresponds to the upward apex of the protrusion 34*a* of the contact portion 34 of the signal contact 6.

Similarly, as shown in FIG. 15 the second distance D2 is defined as a distance in the front-back direction to a contact point of the ground contact 10 with respect to the ground terminal 3 with the back surface 51 of the housing 8 as the reference. In this embodiment, the contact point of the ground contact 10 with respect to the ground terminal 3 corresponds to the downward apex of the contact portion 44 of the ground contact 10.

As is obvious from the comparison between FIGS. 15 and 16, the first distance D1 and the second distance D2 are set to be substantially equal to each other. This makes it possible to reduce the depth of the connector 1 as compared with the structure in which the first distance D1 and the second distance D2 are quite different from each other (e.g., a connector disclosed in Patent Document 1).

The first preferred embodiment of the present invention has been described above. In summary, the first embodiment has the following features.

That is, the connector 1 used for being mounted on the connector mounting surface 5*a* of the substrate 5 so as to connect the FFC 4 having the plurality of signal terminals 2 and a single ground terminal 3 to the substrate 5 includes the plurality of signal contacts 6, the ground contact 10, and the housing 8. The signal contacts 6 are arranged to come into contact with the signal terminals 2 of the FFC 4, respectively. The ground contact 10 comes into contact with the ground terminal 3 of the FFC 4. The housing 8 holds the plurality of signal contacts 6 and the ground contact 10. When viewed along a direction in which the plurality of signal contacts 6 are arranged, assuming that the back surface 51 serving as an end of the housing in the direction in which the FFC 4 is inserted into or removed from the connector 1 as the reference, the first distance D1 to a contact point of the signal contact 6 with respect to the signal terminals 2 is set to be substantially equal to the second distance D2 to a contact point of the ground contact 10 with respect to the ground terminal 3. The above-mentioned structure makes it possible to reduce the depth of the connector 1 as compared with the structure in which the first distance D1 and the second distance D2 are quite different from each other (e.g., a connector disclosed in Patent Document 1).

It is a common technical knowledge that the width of a connector is reduced to downsize the connector. This is because miniaturization by narrowing pitches (higher density) is a large factor for reducing the connector width. The present invention has an established technical meaning that is highly appreciated, especially in the case of connecting a shielded FPC or FFC, in addition to such a common technical knowledge (i.e., miniaturization of the signal line portion). The ground terminal and the signal terminals, which are conventionally arranged in the FPC insertion direction, are arranged laterally, so that the connector has the same size in the FPC insertion direction as the conventional connector with no shield. Further, the ground contact terminal and the connector fixing fitting are combined into one function, thereby minimizing an increase in dimensions in the width direction. Consequently, the area of the component mounting surface of the substrate occupied by the connector can be made smaller than that of the conventional ground connection type. This contributes to higher density component mounting on an electronic component mounting surface.

Note that the first distance D1 shown in FIG. 16 and the second distance D2 shown in FIG. 15 are measured in the state where the actuator 9 is tilted and the FFC 4 is connected to the connector 1 as shown in FIGS. 15 and 16. Further, when the first distance D1 varies among the plurality of signal contacts 6, an average value of the first distances D1 is considered as the first distance D1.

In this embodiment, the connector 1 is structured such that the first distance D1 and the second distance D2 are substantially equal to each other. In other words, when the connector 1 is viewed in a plane, the contact point of the signal contact 6 with respect to the signal terminals 2 and the contact point of the ground contact 10 corresponding to the ground terminal 3 are substantially aligned. This prevents the following problem: when an external force that deflects the FFC 4 acts on the FFC 4, one of the contact point of the signal contact 6 with respect to the signal terminals 2 and the contact point of the ground contact 10 with respect to the ground terminal 3 acts as a fulcrum, and the other of the contacts acts as a point of action, so that the contact pressure at one of the contacts is decreased by the principle of leverage. Thus, even when some external force is applied to the FFC 4 in the state where the FFC 4 is connected to the connector 1, the connector 1 allows the FFC 4 to be electrically connected to the substrate 5 with reliability.

As shown in FIGS. 1 and 2, for example, the connector 1 is structured such that the contacts between the ground terminal non-overlap portion 3*a* of the ground terminal 3 of the FFC 4 and the contact portion 44 of the ground contact 10 of the metal member 7 and the contacts between the signal terminal 2 of the FFC 4 and the protrusion 34*a* of the contact portion 34 of the signal contact 6 are entirely sandwiched in the right-left direction of the connector 1. In other words, the former contacts are positioned in the center spaced-apart direction when viewed from the latter contacts.

The connector 1 further includes a contact pressure generating portion (plate spring 39). The contact pressure generating portion is adapted to generate a contact pressure between the ground terminal 3 of the FFC 4 and the ground contact 10 when the FFC 4 is inserted into the connector 1. According to the above structure, a so-called temporary holding function for holding the FFC 4 in the connector 1 can be achieved.

Further, the contact pressure generating portion is provided on the opposite side to the ground contact 10 with the FFC 4 interposed therebetween, and is composed of a pressing member that presses the ground terminal 3 of the FFC 4 against the ground contact 10. According to the above structure, the contact pressure generating portion can be achieved with a simple structure.

The ground contact 10 and the plate spring 39 are integrally formed. According to the above structure, the plate spring 39 can be achieved at low cost.

The temporary holding structure composed of the ground contact 10 and the plate spring 39 is adapted to be capable of changing a position relative to the housing 8. According to the above structure, even if an external force that deflects the FFC 4 acts on the FFC 4, the temporary holding structure can exert a so-called temporary holding function stably and continuously.

The plurality of signal contacts 6 are ZIF (Zero Insertion Force) type. The connector 1 also includes the actuator 9. The actuator 9 allows the plurality of signal contacts 6 to come into contact with the plurality of signal terminals 2, respectively. According to the above structure, only a resistance due to the contact pressure is generated when the FFC 4 is inserted into the connector 1. Accordingly, an excellent assembling operability and a so-called temporary holding function for holding the FFC 4 in the connector 1 during operation of the actuator 9 can be achieved without contradiction.

A pair of temporary holding structures each composed of the ground contact 10 and the plate spring 39 are provided at positions where the plurality of signal contacts 6 are sandwiched in the direction in which the plurality of signal contacts 6 are arranged. According to the above structure, two temporary holding functions are exerted at positions apart from each other, thereby achieving a more stable temporary holding function.

Further, the pair of temporary holding structures are separately formed. According to the above structure, even if the number of the plurality of signal contacts 6 increases, there is no need to change the design of the temporary holding structure itself, thereby suppressing an increase in costs.

The connector 1 also includes the metal members 7 for fixing the housing 8 to the connector mounting surface 5*a* of the substrate 5. The ground contact 10 and the metal members 7 are integrally formed. According to the above structure, the connector 1 including the metal members 7 can be achieved at low cost.

The first embodiment may be modified as described below, for example.

That is, while the FFC 4 is connected to the connector 1 in the first embodiment, a flexible printed circuit (FPC) having a conductor formed by etching may be connected to the connector 1, in place of the FFC 4.

Furthermore, in the first embodiment, the temporary holding structure is formed by sandwiching both the ground terminal 3 and the base polyimide 11 of the FFC 4 so as to hold the FFC 4. Alternatively, the temporary holding structure may be formed by sandwiching only the base polyimide 11 of the FFC 4 so as to hold the FFC 4.

Furthermore, in the first embodiment, the actuator 9 and the temporary holding structure are independent from each other in operation. Alternatively, it is possible to employ a structure in which the contact pressure between the ground terminal 3 of the FFC 4 and the contact portion 44 of the ground contact 10 positively increases when the actuator 9 is tilted to the horizontal position from the upright position.

(Second Embodiment)

Figure 17:
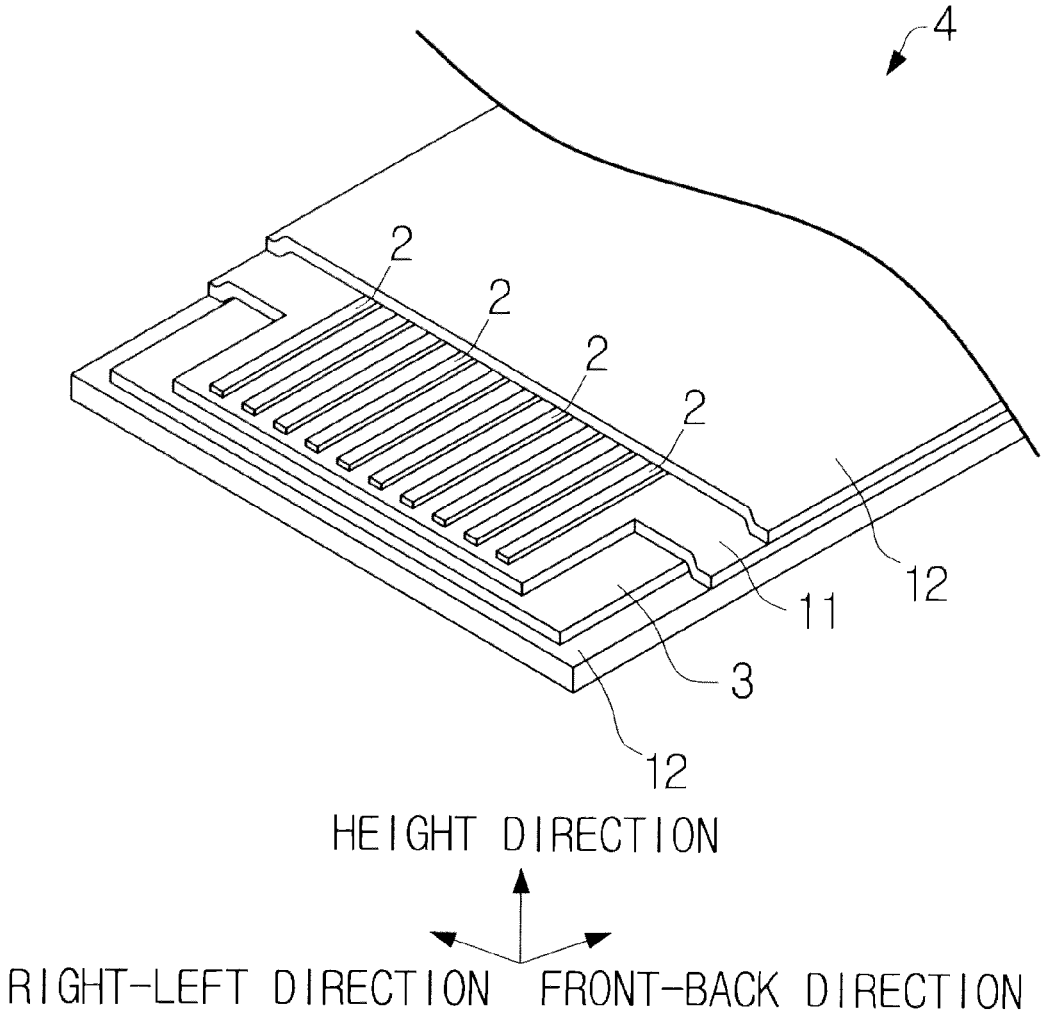
FIG. 17 is a perspective view of an FFC according to a second embodiment of the present invention.

Referring next to FIG. 17, a second embodiment of the present invention will be described. Here, differences between the second embodiment and the first embodiment will be mainly described, and a duplicate description will be omitted as appropriate. The components corresponding to the components of the first embodiment are denoted by the same reference numerals as a rule.

In the first embodiment, as shown in FIGS. 3, 4, and 16, the FFC 4 is structured such that the signal terminals 2 and the ground terminal 3 are exposed in opposite directions with the base polyimide 11 interposed therebetween. Accordingly, the protrusion 34*a* (signal contact portion) serving as a contact portion with respect to the signal terminals 2 of the signal contact 6 and the contact portion 44 (ground contact portion) serving as a contact portion with respect to the ground terminal 3 of the ground contact 10 are arranged on the opposite sides with the FFC 4 interposed therebetween. Alternatively, as shown in FIG. 17, the signal terminals 2 and the ground terminal 3 may be structured to be exposed in the same direction. In the example shown in FIG. 17, the base polyimide 11 that provides insulation between the ground terminal 3 and the signal terminals 2 is partially missing, and the ground terminal 3 is exposed from the missing portion in the same direction as the direction in which the signal terminals 2 are exposed. In this case, in the metal members 7 shown in FIG. 11, the plate spring 39 exerts the function of the ground contact, and the ground contact 10 exerts the function of the plate spring. In other words, the signal contact portion serving as a contact portion of the signal contact 6 with respect to the signal terminals 2 and the ground contact portion serving as a contact portion of the ground contact 10 with respect to the ground terminal 3 are arranged on the same side when viewed from the FFC 4. As in the first embodiment, the laminate of the ground terminal 3, the base polyimide 11, and the signal terminals 2 as shown in FIG. 17 is covered with the shield member 12 as appropriate.

In addition, as shown in FIG. 18, the temporary holding structure can also temporarily hold the FFC 4 of a so-called single-layer type which is not provided with the ground terminal 3, like the FFC 4 including the ground terminal 3. That is, the same connector can be used regardless of the use of the FPC/FFC depending on the presence or absence of the ground to be used, thereby suppressing an increase in the number of kinds of components and reducing the costs. Moreover, even when a sufficient performance can be obtained by using the FPC/FFC with no ground after completion of a product, for example, the FPC/FFC which has no ground and is produced at low cost can be replaced and used without changing the connector.

(Third Embodiment)

Figure 19:
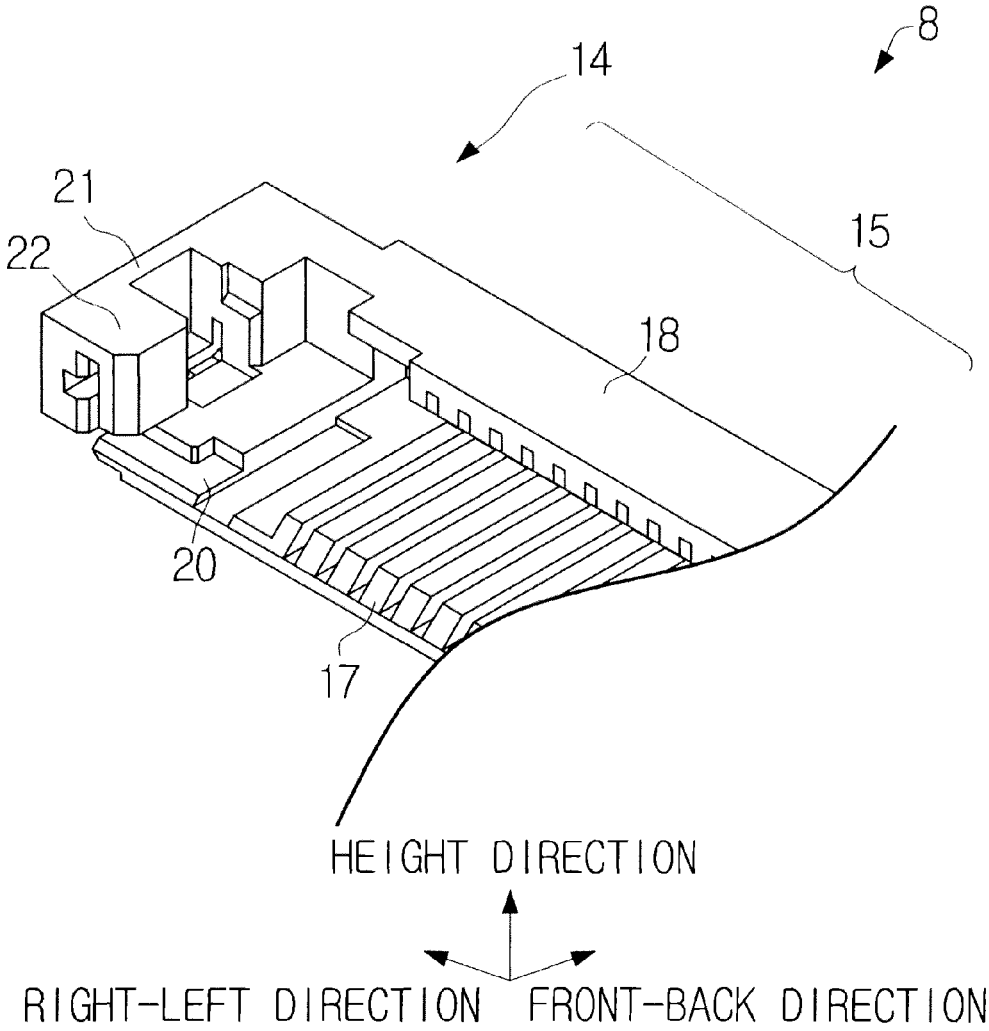
FIG. 19 is a partial enlarged perspective view of a housing according to a third embodiment of the present invention.
Figure 20:
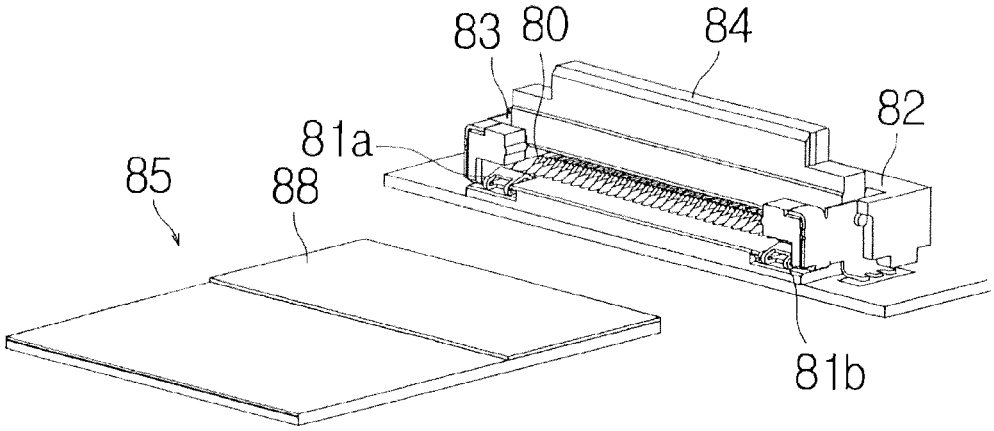
FIG. 20 is a diagram corresponding to FIG. 1 of Patent Document 1.
Figure 21:
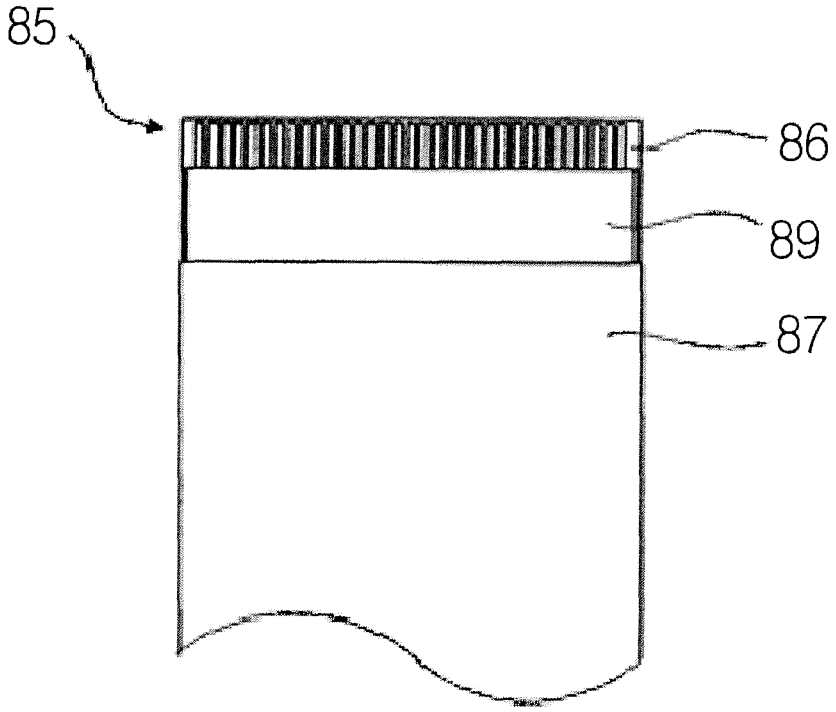
FIG. 21 is a diagram corresponding to FIG. 3 of Patent Document 1.

Next, a third embodiment of the present invention will be described with reference to FIG. 19. Here, differences between the third embodiment and the first embodiment will be mainly described, and a duplicate description will be omitted as appropriate. The components corresponding to the components of the first embodiment are denoted by the same reference numerals as a rule.

In the first embodiment, as shown in FIGS. 3 to 6, at each of the housing ends 14 of the housing 8, the removal preventing protrusion 23 is provided. The removal preventing protrusion 23 is fit into the notch 13 of the FFC 4, thereby obtaining the powerful effect of preventing the removal of the FFC 4 from the connector 1. Alternatively, the removal preventing protrusion 23 may be omitted as shown in FIG. 19. When the removal preventing protrusion 23 is omitted in this way, the technical significance of the temporary holding structure itself that temporarily holds the FFC 4 is made clearer.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims

What is claimed is:

1. A connector for connecting one of a flexible flat cable (FFC) and a flexible printed circuit (FPC) having a plurality of signal terminals and at least one ground terminal to a substrate, the connector being mounted on the substrate, the connector comprising:

a plurality of signal contacts arranged to come into contact with the plurality of signal terminals of one of the FFC and the FPC, respectively;

at least one metal member;

a housing that holds the plurality of signal contacts and the at least one metal member; and a pressurizing member that is rotatable and allows the plurality of signal contacts to come into contact with the plurality of signal terminals, respectively, wherein the at least one metal member comprises a ground contact that contacts the at least one ground terminal of one of the FFC and the FPC and a plate spring that is integrally formed with the ground contact and is provided on an opposite side to the ground contact with one of the FFC and the FPC interposed therebetween and is opposed to the ground contact in a height direction, the height direction being a direction perpendicular to a connector mounting surface of the substrate, the connector mounting surface being a surface the connector is mounted on, and generates a contact pressure between the at least one ground terminal of one of the FFC and the FPC and the ground contact when the FFC or FPC is inserted into the connector by pressing the at least one ground terminal of one of the FFC and the FPC against the ground contact, a first distance from an end of the housing to a contact point of each signal contact with each signal terminal is set to be substantially equal to a second distance from the end of the housing to a contact point of the ground contact with the ground terminal, the first and second distances being measured along a direction in which one of the FFC and the FPC is inserted into or removed from the connector, the ground contact and the plate spring constitute a temporary holding structure that changes a position relative to the housing, the temporary holding structure being independent in operation from the pressurizing member, and the plurality of signal contacts are zero insertion force (ZIF) type.

2. The connector according to claim 1, wherein the at least one metal member comprises a pair of the metal members that sandwich the plurality of signal contacts in a direction in which the plurality of signal contacts are arranged.

3. The connector according to claim 2, wherein the pair of metal members are separately formed.

4. The connector according to claim 3, wherein the pair of ground contacts sandwich the plurality of signal contacts in the direction in which the plurality of signal contacts are arranged.

5. the connector according to claim 4, wherein the pair of ground contacts are separately formed.

6. The connector according to claim 1, wherein the at least one metal member is fixed to the substrate.

7. The connector according to claim 1, wherein a plurality of signal contact portions serving as a plurality of contact portions of the plurality of signal contacts with respect to the plurality of signal terminals are disposed on an opposite side to a ground contact portion serving as a contact portion of the ground contact with respect to the ground terminal with one of the FFC and the FPC interposed therebetween.

8. The connector according to claim 1, wherein a plurality of signal contact portions serving as a plurality of contact portions of the plurality of signal contacts with respect to the plurality of signal terminals are disposed on the same side as a ground contact portion serving as a contact portion of the ground contact with respect to the ground terminal, when viewed from one of the FFC and the FPC.

* * * * *